United States Patent [19]

Garrison

[11] 4,194,274

[45] Mar. 25, 1980

[54] GARMENT GRIP CONSTRUCTION FOR HANGERS

[75] Inventor: Judd F. Garrison, Grand Rapids, Mich.

[73] Assignee: John Thomas Batts, Inc., Zeeland, Mich.

[21] Appl. No.: 893,962

[22] Filed: Apr. 6, 1978

[51] Int. Cl.[2] ..... A44B 21/00

[52] U.S. Cl. ..... 24/248 R; 223/91

[58] Field of Search ..... 24/248 R; 223/91

[56] References Cited

U.S. PATENT DOCUMENTS

| | | | |
|---|---|---|---|
| D. 171,091 | 12/1953 | Karpel . | |
| 2,145,120 | 1/1939 | Loveless | 223/91 |
| 2,686,520 | 8/1954 | Jarvis | 24/248 R |
| 2,765,487 | 10/1956 | Foster | 24/137 A |
| 3,123,331 | 3/1964 | Field . | |
| 3,137,027 | 6/1964 | Birkle . | |
| 3,214,810 | 11/1965 | Mathison . | |
| 3,292,223 | 12/1966 | Esposito | 24/137 R |
| 3,604,071 | 9/1971 | Reimels . | |
| 3,608,554 | 9/1971 | McGuinness | 24/248 R |
| 3,698,607 | 10/1972 | Batts . | |
| 3,745,616 | 7/1973 | Batts . | |
| 3,755,859 | 9/1973 | Solari | 24/16 PB |
| 3,767,092 | 10/1973 | Garrison . | |
| 3,767,092 | 10/1973 | Batts | 223/96 |
| 3,822,734 | 7/1974 | Tombu | 24/148 R |
| 3,982,307 | 9/1976 | Smith | 24/137 R |
| 4,038,726 | 8/1977 | Takabayashi | 244/248 R |

FOREIGN PATENT DOCUMENTS

| | | | |
|---|---|---|---|
| 219087 | 7/1924 | United Kingdom | 24/250 |

*Primary Examiner*—Nile C. Byers, Jr.

*Attorney, Agent, or Firm*—Price, Heneveld, Huizenga & Cooper

[57] ABSTRACT

A clamp type garment hanger including a garment grip construction is disclosed. The hanger includes at least one clamp having a pair of hinged clamp members, each of which includes an inner surface. A spring clip biases the inner surfaces of the clamp members towards each other to clamp a garment therebetween. The opposed inner surfaces of the clamp members define a serpentine or generally S-shaped passage within which the article to be suspended is clamped. A plurality of opposed, elongated projections extend outwardly from the inner surfaces of each of said clamp members into the S-shaped passage.

10 Claims, 6 Drawing Figures

GARMENT GRIP CONSTRUCTION FOR HANGERS

BACKGROUND OF THE INVENTION

The present invention relates to article suspension devices and more particularly to a clamping type garment hanger.

Clamping type hangers have heretofore been provided for the suspension or hanging of a wide variety of articles such as pants, skirts, and carpet samples. Such hangers include at least one clamp typically defined by a pair of opposed wing or clamp members between which the article is placed. Provision is made for biasing the members together to create the clamping force necessary to retain the article. Hangers of this type have been manufactured by a simple molding process as a single, integral unit employing a two-piece mold.

In order to increase the capacity of such clamp type hangers so that they may be used to display relatively heavy articles such as pants, slacks, carpet, fabric samples or boots, for example, provision has been made to increase the clamping force between the clamp members. An example of one such structure adapted to increase the clamping force may be found in commonly owned U.S. Pat. No. 3,767,092, entitled GARMENT CLAMPING HANGER WITH SLIDABLE LOCKING CLIP and issued on Oct. 23, 1973 in the names of Judd F. Garrison and John H. Batts. As disclosed in this patent, a pair of integrally hinged clamp members are biased together and locked by a generally U-shaped spring clip. The opposed, facing, inner surfaces of the clamping members are also provided, in one embodiment, with a plurality of conical projections or pointed tooth-like members which embed themselves into the article suspended to increase the holding capability of the clamp. These grip increasing teeth permit the clamp to suspend heavier articles. In another embodiment illustrated in this patent, each of the gripping members includes parallel projections which extend laterally almost the entire width of the member on the lower portion thereof. These projections are in effect elongated bars which provide a grip increasing surface. Other examples of prior art clamping type hangers may be found in commonly owned U.S. Pat. No. 3,698,607 entitled GARMENT CLAMPING HANGER and issued on Oct. 17, 1972, in the name of John H. Batts and U.S. Pat. No. 3,745,616 entitled CLAMP WITH IMPROVED LATCH and issued on July 17, 1973, in the name of John H. Batts.

Heretofore, the service life of clamping type hangers has been limited by the normal reduction in the clamping force generated by the biasing means through repeated use. As the clamping force decreases due to relaxation of the biasing means, the excess clamping ability over that necessary to hold an article reduces. At some point, the clamping force generated is insufficient to suspend the article. The hanger can then be used only to suspend lighter weight articles or it must be discarded. Also, it has been found that pointed or conical tooth-like projections formed on the opposed surfaces of the clamp members have a tendency to wear after repeated use and to become barbed-like in cross section. The worn teeth may then snag the article suspended from the hanger.

SUMMARY OF THE INVENTION

A need therefore exists for a clamp usable in a clamping type hanger which has increased clamping and gripping capability than that heretofore provided to maintain an adequate level of gripping or clamping force as a natural reduction occurs through repeated use. Also, a need exists for a clamp which will generate sufficient clamping force and holding ability but which will not snag or damage the article suspended. Essentially, the unique clamp in accordance with the present invention includes a pair of opposed clamp members, each having an inner surface and provision for biasing the inner surfaces towards each other to clamp an article therebetween. Means are provided on the inner surfaces of the clamp members for increasing the clamping pressure exerted on a garment placed between the members and for increasing the force required to pull a garment from between these members. The means includes a serpentine or curvilinear passage defined by the inner surfaces of the clamp members and within which the article is received and a plurality of generally parallel rows of elongated projections arranged end-to-end and extending from the inner surfaces of the clamp members into the serpentine article receiving passage.

In narrower aspects of the invention, at least some of the projections are angled upwardly slightly from the horizontal when the clamp members are positioned to received an article to thereby increase the holding ability of the clamp.

DETAILED DESCRIPTION OF THE PREFERRED EMBODIMENT

Figure 1:
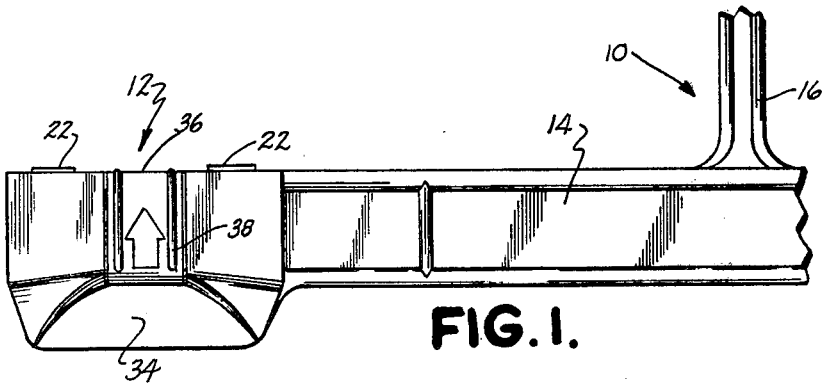
FIG. 1 is a fragmentary, front elevational view of a garment hanger including a clamp having the unique garment grip construction in accordance with the present invention.

FIG. 1 illustrates a clamping type garment hanger generally designated 10 including a clamping device generally designated 12 having the unique garment grip construction in accordance with the present invention. The hanger 10 is of the type described in detail in the aforementioned commonly owned U.S. Pat. No. 3,767,092. The hanger includes a cross bar 14 and a generally centrally located support member 16 by which the hanger is suspended from a rod, hook or the like. A pair of the clamping devices 12 are molded integral at each end of the cross bar 14. Since the clamps are identical, only one has been illustrated.

Figure 2:
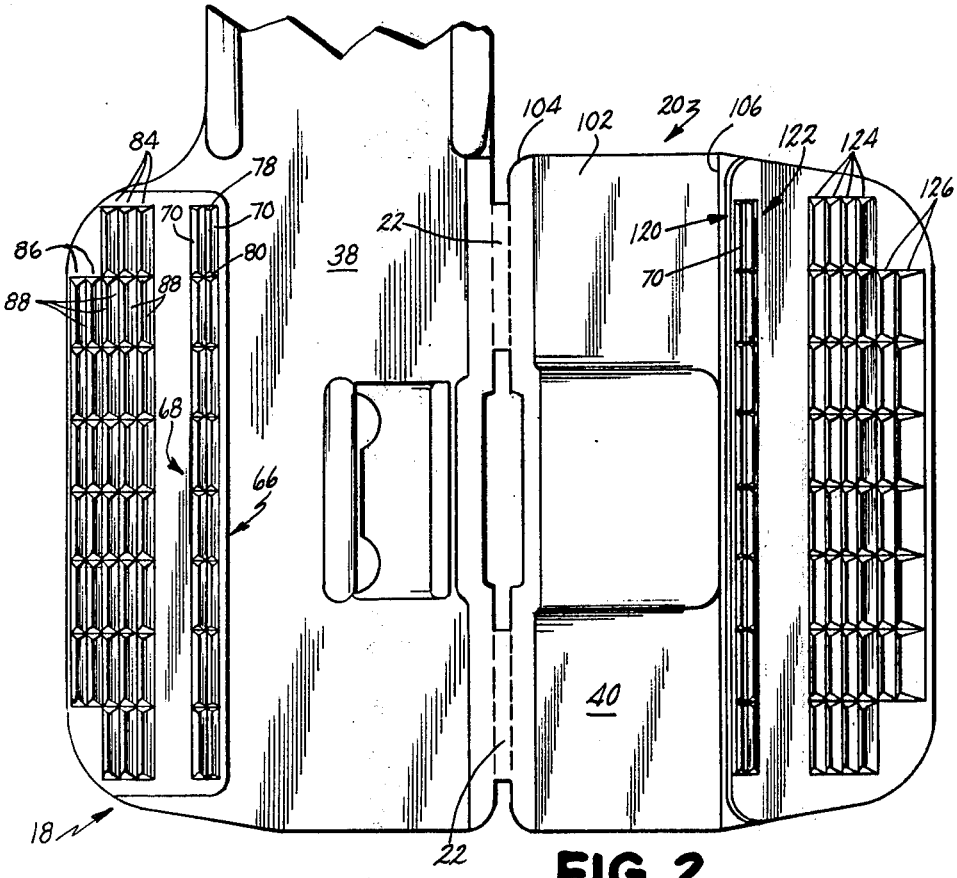
FIG. 2 is an enlarged view of the clamp with the clamp fully opened.
Figure 6:
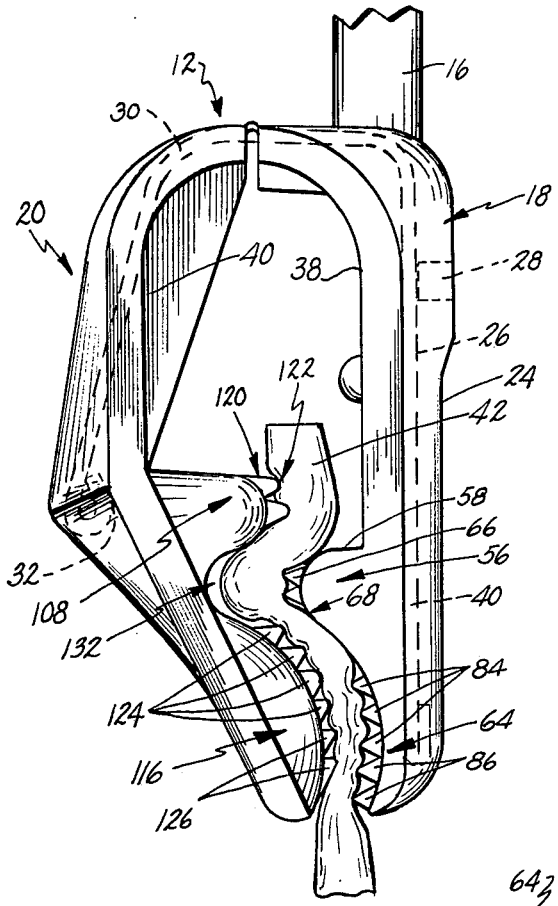
FIG. 6 is a fragmentary, side elevational view of a garment hanger with the clamping device in the closed, clamped position.

As best seen in FIGS. 1, 2 and 6, each of the clamping devices 12 includes a rear gripping member generally designated 18 and molded integral with the cross arm 14 and a front gripping member generally designated 20 which is integrally joined to the rear gripping member 18 by living hinges or integrally molded hinges 22. The outer surface 24 of the rear gripping member 18 defines a recess 26 extending from the top to the bottom thereof. A retainer bar 28 extends across the recess. The outer surface of the gripping member 20 defines a recess 30 having a detent shoulder 32 adjacent the lower end therof. The lower portion 34 (FIG. 1) of the outer surface of gripping member 20 is recessed, cupped or flared. A spring steel biasing or locking clip 36 includes a leg 38 slidably disposed within recess 30 and a leg 40 slidably disposed and retained within recess 26. The generally U-shaped locking clip 36 when pushed downwardly to the position illustrated in FIGS. 1 and 6, biases inner surfaces 38, 40 of the rear clamp member and the front clamp member, respectively, towards each other to exert a clamping force on a garment or other article 42 positioned within the clamp (FIG. 6).

In order to open the clamping device 12, a user need only place a finger or thumb in the cupped area 34 and slide the locking clip upwardly. The front clamp member 20 may then be pivoted about the hinges 22 away from the rear grip member 18 to permit removal or placement of an article between the inner surfaces 38, 40 of the clamp members. As set forth above, a more detailed description of these basic elements of the clamping device 12 including the recesses defined in the outer surfaces of the front and rear grip members as well as the configuration and operation of the locking clip may be found in the aforementioned U.S. Pat. No. 3,767,092. To the extent necessary, the disclosure of this patent is hereby incorporated by reference.

Figure 3:
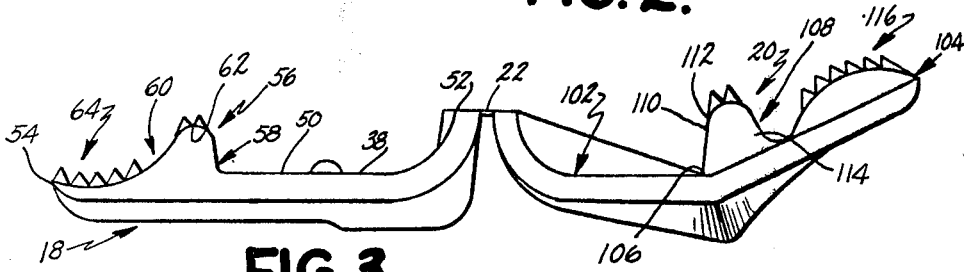
FIG. 3 is an enlarged, side elevational view of the clamp of FIG. 2.
Figure 4:
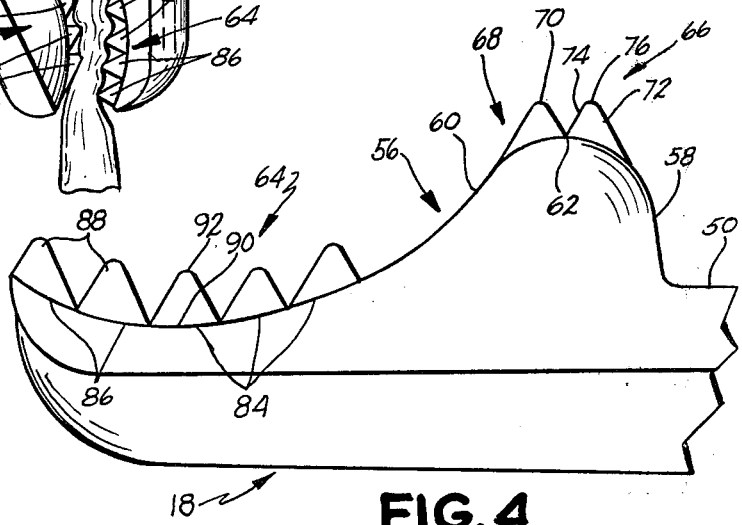
FIG. 4 is a greatly enlarged, fragmentary elevational view of one of the clamp members of the clamp.

As seen in FIGS. 2, 3 and 4, the inner surface 38 of the rear clamp member 18 includes a first, generally rectangular, planar portion 50 extending from an upper lateral edge 52 downwardly towards a lower or free end 54 of the inner surface. Extending substantially the entire width of the inner surface 38 and generally parallel to the upper lateral edge 52 is an outwardly extending ridge or protrusion 56. The ridge 56 includes a first or upper side surface 58 defining a slightly downwardly angled edge and a second, lower side surface 60. The upper surface 58 extends at an angle from a line perpendicular to the inner surface portion 50 of the clamp member. For ease of description, the frame of reference of the clamp members is taken to be that of their normal operating position as shown in FIG. 6. In a presently existing embodiment, the downward angle when viewed in FIG. 6 is approximately 3°. The crest 62 of the ridge 56 is curved and smoothly joins the curved side 60. The lower portion 64 of the inner surface 38 is curved along a constant radius equal to the radius of curvature of the side portion 60 of ridge 56.

Extending across the crest 62 of the ridge 56 are two, parallel rows 66, 68 of elongated, tandemly arranged projections or bar-like teeth 70. As best seen in FIG. 4, the bar-like teeth 70 or projections are generally V-shaped in cross section and include angularly related sides 72, 74 and a generally rounded apex 76. The ends 78 of the projections 70 are slightly beveled so as to leave a distinct space 80 between the individual projections 70 (FIG. 2). Each tooth 70 extends generally outwardly from the ridge 56 in a plane generally perpendicular to a plane defined by the planar portion 50 of the inner surface 38 of the clamp member. In the presently preferred embodiment, each row 66, 68 includes an equal number of equally dimensioned teeth 70.

Positioned on the concave surface 64 below the ridge 56 are a plurality of rows 84, 86 of elongaed projections or bar-like teeth 88. The rows 84 extend across substantially the entire width of the concavity 64 in spaced, parallel relationship with rows 66, 68 on ridge 56. The lateral sides of each of the teeth 88 and rows 84 abut and the teeth 84 are in tandem end-to-end relationship. This is best seen in FIG. 2. The rows 86 extend parallel to the rows 84 but contain a lesser number of teeth 88 than the rows 84. The elongated projections or teeth 88 are therefore arranged in a generally T-shaped manner or pattern along the concavity 64. As best seen in FIG. 4, each individual projection 88 is generally V-shaped in cross section and extends from a base 90 outwardly to an apex 92 substantially the same distance from the concavity or concave surface 64.

Figure 5:
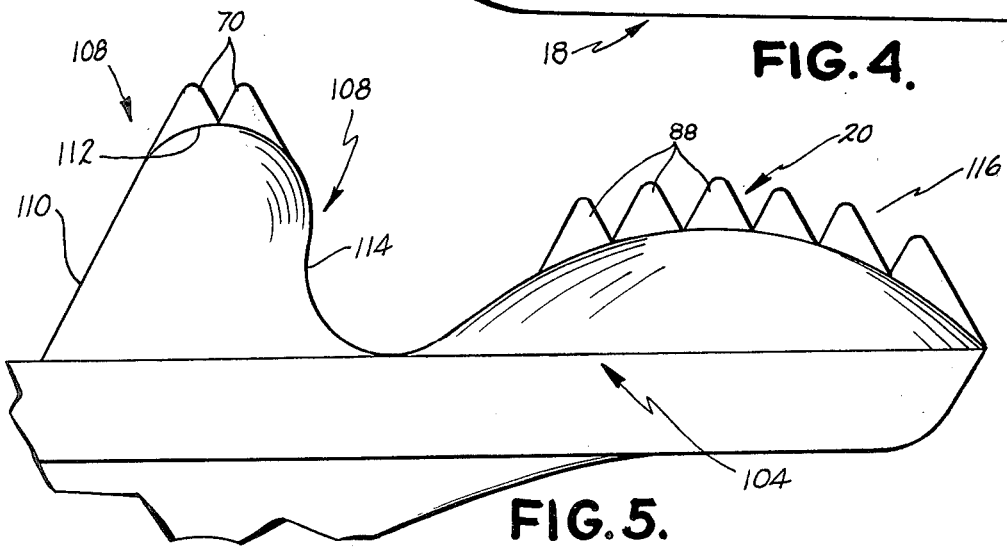
FIG. 5 is a greatly enlarged, fragmentary elevational view of the other clamp member of the clamp.

As best seen in FIGS. 2, 3 and 5, the front clamp member 20 includes a first, generally planar portion 102, the upper lateral edge 104 of which is hingedly joined to the upper lateral edge of the rear gripping member by hinge elements 22. Integrally formed with the planar portion 102 is an angularly related portion 104. Portions 104 and 102 therefore define the inner surface 40 of the front clamp member 20. Extending outwardly adjacent a lateral edge 106 of planar portion 102 is a ridge or protrusion 108. Protrusion 108 as with ridge 56 includes a first side 110 which is angled slightly from a line extending generally perpendicular to the planar portion 102 to define a ledge. Ridge 108 includes a rounded crest 112 and a curvilinear side 114. The ridge 108 extends substantially the entire width of the inner face or surface 38 of the front clamp member. Extending in spaced, parallel relationship with the ridge 108 is another ridge 116. Ridge 116 has a radius of curvature greater than the radius of curvature at the crest area of ridge 108 and extends outwardly away from the surface of portion 104 a distance less than that of ridge 108.

Extending along substantially the entire crest 112 of ridge 108 are two rows 120, 122 of elongated projections or bar-like teeth 70. Extending outwardly or away from the curved crest or surface of ridge 116 are a plurality of rows 124 and 126 of projections 88. The rows 124, 126 extend in spaced, parallel relationship with the rows 120, 122 on ridge 108.

As best seen in FIG. 2, it is presently preferred that rows 124 and 126 include a greater number of projections 88 than rows 84, 86. It is presently preferred that each row 124 include eight teeth and that four such rows be provided. It is presently preferred that row 126 include six teeth and that two such rows be provided. In contrast, it is presently preferred that rows 84 also include eight teeth, but that only three such rows be provided. Rows 86 include six teeth and preferably two such rows are provided.

As best seen in FIG. 6, ridges 108 and 116 are in effect separated by an elongated recess or trough 132 and the concave surface or concavity 64 on rear clamp member 18 has a radius of curvature substantially equal to the radius of curvature of ridge 116. When the clamp members are in their closed or clamped position, the ridge 56 extends at least partially into the trough or recess 132 defined by clamp member 20. The inner surfaces 38, 40 of the rear and front clamp members therefore define the unique article or garment grip construction having a serpentine, curvilinear or generally S-shaped article receiving passage and bar-like protrusions or projections 70 and 88 extending into the passage. As seen in FIG. 6, it is preferred that the rows 120, 122 of projections 70 on ridge 108 extend generally upwardly from a horizontal plane extending through the clamp members when the members are in the closed, clamping position.

Similarly, the rows 124, 126 and 84, 86 of projection 88 also extend slightly upwardly from a horizontal plane passing through the clamp members. This slight upward angling of the elongated, bar-like teeth serves to substantially increase the gripping ability and article holding capacity of the clamp 12.

When an article 42 to be held by the clamp device 12 is placed between the inner and outer surfaces 38 and the clamp members are biased towards each other by the biasing means or spring clip 36, the article 42 will assume a generally serpentine configuration within the passage defined by the opposed facing surfaces 38, 40 of the clamp members. This curvilinear configuration results in a substantial increase in the clamping pressure exerted on the article since the clamping force created by the biasing means 36 will include a vertical component acting along a substantially linear or line contact area adjacent the inner face of the crest 62 and the side 58 of ridge 56 and also adjacent the apex of the rows of teeth 84, 86. Further, each of the projections 70 and 88 will embed themselves into or compress the article 42. This also serves to increase the holding capabilities of the clamp 12. Also, as is apparent from FIG. 6 rows 84 of projections 88 on rear gripping member 18 extend towards and in effect interlock with some of the rows 124 and 126 of projections 88 on the front gripping member. This interlocking serves to further increase the holding capabilities of the clamp 12. The angular relationship of portion 104 of the front clamp member to portion 102 is selected to insure that the ridges formed on the respective members define the serpentine or generally S-shaped passage. Since the contact area at which the clamping force acts on the article 14 is reduced, the clamping pressure generated along these line contact areas is substantially increased from that heretofore provided. This is accomplished even though the total surface area contacting the article is increased from that which would result if the inner surfaces 38, 40 of the clamp members are planar and parallel to each other. Since the clamping force along these areas of line contact includes a vertical component due to the serpentine nature of the passage, the effective frictional force exerted on the article 42 is also increased from that heretofore obtained. As a result, a vertical force pulling downwardly on the article 42 when suspended as illustrated in FIG. 6 necessary to pull the article from between the clamp members is substantially increased from that necessary with conventional clamps.

In a presently existing embodiment, the projections 70 each extend away from their respective inner surfaces a distance of approximately 0.025 inches and have a width across their base of approximately 0.04 inches. Each tooth therefore has an aspect ratio equal to height over base width less than 1 and approximately equal to 0.625. Each of the projections 88 extends outwardly from the respective surfaces a distance approximately equal to 0.035 inches and have a base width of approximately 0.045 inches thereby having an aspect ratio of approximately 0.77 or less than 1. Each of the teeth 70 and 88 have a longitudinal dimension or length of approximately 0.2 inches or approximately 8 times the base width. The distance from the inner surface of each clamp member outwardly to the apex of a tooth 70 on the ridges 56 and 108 is approximately 5/32 inch and the ridge 116 and concavity 64 have a radius of curvature of approximately ¼ inch. The crest of each ridge 56, 108 has a radius of curvature of approximately 0.062 inches. Clamp member 20 includes 60 teeth and clamp member 18 includes 52 teeth as illustrated in FIG. 2. The surfaces or sides 58, 110 are angled downwardly from a plane parallel to portions 50 and 102, respectively, approximately 3°. Portion 104 assumes an angle of 25° relative to portion 102.

The unique clamp 12 in accordance with the present invention readily suspends a wide variety of articles and may be used singly or a plurality may be incorporated into the hanger. The uniquely configured garment or article gripping surfaces defined by the ridges, recesses and concavity are easily molded integral with the clamp members by a simple molding process using a two-piece mold. The clamping device or garment grip construction is therefore easily and relatively inexpensively manufactured. The clamp 12 has a substantially increased excess holding or gripping capability than has theretofore been provided by presently available clamps. This excess holding capability insures that the clamp will continue to function reliably for a longer period of time even though the biasing force exerted on the clamp members tends to decrease as the biasing element fatigues or relaxes due to repeated use. Further, the elongated nature of the teeth of projections 70, 88, as well as their general configuration including the slight rounding of their apices, insures that the article suspended by the clamp will not be snagged or torn as has heretofore occurred with the prior conical projections as they have worn into a barbed-like configuration. The gripping action resulting from a plurality of teeth positioned across the clamps is, however, retained.

In view of the foregoing description, those of ordinary skill in the art will undoubtedly envision various modifications to the unique clamp in accordance with the present invention which would not depart from the inventive concepts disclosed herein. For example, the number of teeth provided on the respective areas of the clamp members could be varied from that illustrated as well as the general configuration of the serpentine, curvilinear or S-shaped passage defined by these members when they are in opposed, clamping relationship. The primary considerations involve providing a serpentine passage as well as grip increasing means in the form of projections which are preferably angled slightly upwardly when in an operative position to increase the clamp retention capabilities.

The grip construction may be used in a wide variety of clamp-type hangers. For example, the hangers illustrated in commonly owned U.S. Pat. No. 3,665,563, entitled CLAMP and issued on May 30, 1972, and U.S. Pat. No. 3,698,043, entitled MOLDED GARMENT CLAMP and issued on Oct. 17, 1972, each include opposed clamp members, the inner surfaces of which could be modified to incorporate the grip construction in accordance with the present invention. These hangers each employ a biasing latch as opposed to the locking clip illustrated in the present application. Therefore, it is expressly intended that the above description should be considered as that of the preferred embodiment. The true spirit and scope of the present invention may be determined by reference to the appended claims.

The embodiments of the invention in which an exclusive property or privilege is claimed are defined as follows:

1. An improved clamp usable for clamping garments in a generally vertical orientation, said clamp comprises:

a first clamp member having an inner surface;

a second clamp member having an inner surface;

biasing means engaging said members for biasing said inner surfaces towards each other to exert a clamping force on an article placed between said members when said inner surfaces are in opposed, clamping relationship;

a first elongated ridge having a smoothly rounded crest and extending outwardly from said inner surface of said first clamping member;

a second elongated ridge extending from said inner surface of said first clamp member in spaced, generally parallel relationship with said first ridge to thereby define an elongated recess between said ridges, said second ridge having a smoothly curved surface having a radius of curvature greater than the radius of curvature of the crest of said first ridge;

a third ridge extending from said inner surface of said second clamp member, said third ridge extending at least partially into said elongated recess when said inner surfaces are in opposed clamping relationship whereby the clamping force generated by said biasing means has a vertical component along said second and third ridges and said article is clamped along line contact areas so that the clamping pressure on the article is increased; and a plurality of elongated bar-like teeth, each having a length greater than its width and extending outwardly from said ridges and into an article clamped therebetween, said teeth being generally V-shaped in section and being tandemly arranged in a plurality of parallel rows wherein said inner surface of said second clamp member defines a concavity conforming to the surface of said second ridge and extending the width of said second clamp member.

2. An improved clamp as defined by claim 1 wherein one of said clamp members includes more rows of teeth than the other of said clamp members and at least some of said teeth on said clamp members are angled upwardly from a horizontal plane extending through said clamp members whereby said teeth dig into an article clamped between said members.

3. An improved clamp is defined by claim 2 wherein the majority of the rows of teeth on said first member extend along said second ridge and at least one row of teeth extends along the crest of said first ridge.

4. An improved clamp as defined by claim 3 wherein the majority of the rows of said teeth on said second member are positioned on said concavity and at least one row of teeth extends along the crest of said third ridge.

5. An improved clamp as defined by claim 4 wherein at least some of the rows of teeth on said second ridge interlock with the rows of teeth on said concavity.

6. An improved clamp as defined by claim 5 wherein each of said teeth on said second ridge and on said concavity has an aspect ratio less than 1 and a length of approximately 8 times base width.

7. An improved clamp as defined by claim 6 wherein each of said teeth on said first and third ridges has an aspect ratio less than 1 and greater than the aspect ratio of said teeth on said second ridge and said concavity and a length approximately equal to the length of the teeth on said second ridge.

8. An improved clamp as defined by claim 7 wherein said first and third ridges include upper and lower sides, said upper sides each extending in a plane to define a ledge.

9. An improved clamp as defined by claim 8 wherein said clamp members are joined by a hinge along their upper lateral edges.

10. An improved clamp as defined by claim 9 wherein said clamp is molded as a single piece from a plastic material.

* * * * *

UNITED STATES PATENT AND TRADEMARK OFFICE

CERTIFICATE OF CORRECTION

PATENT NO. : 4,194,274
DATED : March 25, 1980
INVENTOR(S) : Judd F. Garrison

It is certified that error appears in the above-identified patent and that said Letters Patent are hereby corrected as shown below:

Column 3, line 6:

"therof" should be --thereof--;

Column 3, line 67:

"elongaed" should be --elongated--;

Column 6, line 17:

"theretofore" should be --heretofore--;

Column 6, line 23:

"teeth of" should be --teeth or--.

Signed and Sealed this

*Twelfth* Day of *August 1980*

[SEAL]

*Attest:*

SIDNEY A. DIAMOND

*Attesting Officer*

*Commissioner of Patents and Trademarks*